US006547642B2

(12) United States Patent
Hatano

(10) Patent No.: US 6,547,642 B2
(45) Date of Patent: Apr. 15, 2003

(54) LENS PERIPHERY PROCESSING METHOD FOR EYEGLASS LENS, LENS PERIPHERY PROCESSING MACHINE AND LENS FOR EYEGLASS

(75) Inventor: Yoshiyuki Hatano, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 77 days.

(21) Appl. No.: 09/844,733

(22) Filed: Apr. 27, 2001

(65) Prior Publication Data

US 2001/0036794 A1 Nov. 1, 2001

(30) Foreign Application Priority Data

Apr. 28, 2000 (JP) ..... 2000-130456
Apr. 16, 2001 (JP) ..... 2001-116665

(51) Int. Cl.[7] ..... B24B 9/14

(52) U.S. Cl. ..... 451/11; 451/43; 451/255; 451/178

(58) Field of Search ..... 451/11, 5, 12, 451/13, 23, 42, 43, 44, 120, 178, 255, 256

(56) References Cited

U.S. PATENT DOCUMENTS

| | | | | | |
|---|---|---|---|---|---|
| 4,286,415 | A | * | 9/1981 | Loreto | 451/43 |
| 4,908,996 | A | * | 3/1990 | Friedman et al. | 451/43 |
| 5,056,270 | A | * | 10/1991 | Curcher | 451/255 |
| 5,485,399 | A | * | 1/1996 | Saigo et al. | 345/420 |
| 5,630,746 | A | * | 5/1997 | Gottschald et al. | 451/255 |
| 5,716,256 | A | * | 2/1998 | Mizuno et al. | 451/210 |
| 5,775,973 | A | * | 7/1998 | Watanabe | 451/10 |
| 5,803,793 | A | * | 9/1998 | Mizuno et al. | 451/255 |
| 6,062,947 | A | * | 5/2000 | Obayashi et al. | 451/255 |
| 6,089,957 | A | * | 7/2000 | Shibata | 451/157 |
| 6,122,063 | A | * | 9/2000 | Berndt et al. | 356/623 |
| 6,203,409 | B1 | * | 3/2001 | Kennedy et al. | 451/43 |
| 6,220,927 | B1 | * | 4/2001 | Mizuno et al. | 451/10 |
| 6,290,569 | B1 | * | 9/2001 | Mizuno et al. | 451/43 |
| 6,325,700 | B1 | * | 12/2001 | Mizuno et al. | 451/384 |

FOREIGN PATENT DOCUMENTS

| | | | | | |
|---|---|---|---|---|---|
| JP | 51-119580 | | | 10/1976 | B23Q/35/00 |
| JP | 58-38919 | | | 3/1983 | G02C/13/00 |
| JP | 58-196407 | | | 11/1983 | G01B/21/02 |
| JP | 60-52249 | | | 3/1985 | B24B/9/14 |
| JP | 62-88402 | | | 4/1987 | H01P/5/12 |
| JP | 63-24106 | | | 2/1988 | G01B/7/28 |
| JP | 02198755 | A | * | 8/1990 | B24B/9/14 |
| JP | 09183053 | A | * | 7/1997 | B24B/9/14 |
| JP | 10-113853 | | | 5/1998 | B24B/9/14 |
| JP | 2001259979 | A | * | 9/2001 | B24B/9/14 |
| JP | 2002122407 | A | * | 4/2002 | B24B/5/00 |
| JP | 2002122829 | A | * | 4/2002 | B24B/9/14 |

* cited by examiner

*Primary Examiner*—Joseph J. Hail, III
*Assistant Examiner*—David B. Thomas
(74) *Attorney, Agent, or Firm*—Chapman and Cutler

(57) ABSTRACT

There are provided a lens periphery processing method for an eyeglasses lens, a lens periphery processing machine and lens for eyeglass, in which a V shaped portion that fits strongly in a lens frame of eyeglasses frame, can be processed in such a manner that V shaped portion contact with inside of the V shaped groove of the lens frame so that a contact element does not interfere with a holding means for fixing and holding a lens frame, and even if the V shaped groove shape is measured in a state in which the lens frame is tilted, a difference in size due to holding position between the lens frame and a processed eyeglasses lens does not arise. Measuring the lens frame shape of eyeglasses frame by contacting the contact element 5 having a width narrower than the width of the V shaped groove 1*d*, on the both sides 1*b*, 1*c* of the V shaped groove formed in the inner face of the lens frame for eyeglasses lens, and forming the V shaped portion of said eyeglasses lens in a shape that the eyeglasses lens is put in the V shaped groove with contacting at the points where the contact element contacted on said both sides of the groove, as substantially the deepest contacting points in the groove.

20 Claims, 9 Drawing Sheets

LENS PERIPHERY PROCESSING METHOD FOR EYEGLASS LENS, LENS PERIPHERY PROCESSING MACHINE AND LENS FOR EYEGLASS

BACKGROUND OF THE INVENTION

1. Field of the Invention

The present invention relates to a lens periphery processing method and a lens periphery processing machine for processing an eyeglasses lens, based on lens frame shape data measured by contacting a contact element with a V shaped groove having V shape, formed in the inner face of a lens frame for eyeglasses lens, and the lens for eyeglasses made by those.

2. Description of the Prior Art

Generally, a lens frame which constitutes an eyeglasses frame, is formed with a V shaped groove formed in the inner face thereof, having a pair of inclined faces with its cross section having a V shape.

FIG. 9A is a sectional view, in which a lens frame 1 of an eyeglasses frame (the whole part thereof is omitted) is cut in the direction perpendicular to the frame extending direction. A V shaped groove 1*d* which has inclined faces 1*b* and 1*c* composing a V shape, formed in an inner face 1*a* of a lens frame 1, opens at a given opening angle θ1 from a bottom 1*e* of the V shaped groove toward the V shaped groove edges 1*f* and 1*g*. The opening angle θ1 and a depth H of the V shaped groove, differ slightly depending on the shape, material, manufacturer, and the like of the lens frame 1.

Generally, the shape of the lens frame 1 is measured by contacting a contact element 2 (see FIG. 8A) provided on a frame shape measuring instrument etc., not shown, into contact with the V shaped groove 1*d*.

The contact element 2 is provided with a tip end portion having an abacus bead shape, needle shape, spherical shape, rectangular shape, or the like (see Japanese Patent Application Laid-Open Nos. 51-119580, 58-196407, 58-38919, 60-52249, 62-88402, 63-24106, and 10-113853).

The contact element 2 shown in FIG. 8A has inclined faces 2*a* and 2*b* open at an angle θ2 and it is inserted in the V shaped groove 1*d* so that the points in the tip end portion thereof comes into contact with the V shaped groove edges 1*f* and 1*g* at the same time.

On the other hand, as shown in FIG. 9B, at the periphery of an eyeglasses lens 3 which is framed in the above described lens frame 1, there is formed a V shaped portion 3*d* having a pair of inclined faces 3*b* and 3*c* inclined at an opening angle θ3 (almost the same angle as the above described angle θ2) from a vertex 3*a* of the V shaped portion based on the lens frame shape data of the lens frame 1 measured with the above described contact element.

In this specification hereafter, the portion of eyeglass lens by which the eyeglass lens is correspondingly put into and held by above described V shaped groove, is referred to as the "V shaped portion" as above though actual cross section of the portion in accordance with this invention is rather not triangle.

On the sides of a lens front face 3*e* and lens rear face 3*f* of the V shaped portion 3*d*, a V shaped portion shoulder 3*i* ranging from the inclined face 3*b* of the V shaped portion 3*d* to a lens front edge 3*g*, and a V shaped portion shoulder 3*j* ranging from the inclined face 3*c* to a lens rear edge 3*h*, which have a width different according to the peripheral point of the eyeglasses lens 3, are formed at the same time that the V shaped portion 3*d* is formed. The above described whole construction is referred to as a V shaped portion in this specification.

As shown in FIG. 8B, this V shaped portion is formed by using a grinding wheel 4 having the inclined faces 4*a* and 4*b* opening at an angle θ4 (almost the same angle as the above described angles θ2 and θ3, for example, about 120 degrees).

On the eyeglasses lens 3 having been formed with the V shaped portion, the opening angle θ2 of the contact element 2 is approximately equal to the opening angle θ3 of the V shaped portion 3*d*. Therefore, as shown in FIG. 8C, the inclined faces 3*c* and 3*d* come into contact with the V shaped groove edges 1*f* and 1*g* in a state in which the a portion around vertex 3*a* of the V shaped portion 3*d* intrudes into the V shaped groove 1*d*, by which the eyeglasses lens 3 is framed in the lens frame 1.

The above described prior art has problems as described below. The opening angle θ1 of the V shaped groove 1*d* formed in the lens frame 1 of eyeglasses frame, is not fixed and different according to eyeglasses frame, as described above.

On the other hand, the opening angle θ4 of the grinding wheel 4 for processing the V shaped portion of eyeglasses lens, has a predetermined angle, so that the opening angle θ3 of the V shaped portion 3*d* which is formed at the lens periphery of the eyeglasses lens 3 and processed with the grinding wheel 4, is formed so as to be approximately equal to the opening angle θ4 of the grinding wheel 4. Therefore, the V shaped portion 3*d* has a predetermined angle.

For this reason, when the eyeglasses lens 3 is framed in the V shaped groove 1*d*, because it has the V shaped portion 3*d* processed with the opening angle θ3, the eyeglasses lens 3 can not be framed in a state in which the vertex 3*a* is in contact with the V shaped groove bottom 1*e* of the V shaped groove 1*d*. As shown in FIG. 8C, the V shaped groove edges l*f* and l*g* of the V shaped groove 1*d* in the lens frame 1, come into contact with the inclined faces 3*b* and 3*c* of the V shaped portion 3*d*.

However, the eyeglasses lens in this state is merely held only at the V shaped groove edges 1*f* and 1*g* of the eyeglasses frame, strong holding has not been expectable.

The reason for this is that since the opening angle θ3 of the V shaped portion 3*d* is formed so as to be approximately equal to the opening angle θ4 of the grinding wheel 4 (V shaped portion forming grinding wheel), the lens frame shape data is obtained by the contact element 2 having the opening angle θ2 which is approximately equal to the opening angle θ4 of the grinding wheel 4 (V shaped portion forming grinding wheel) in order to make the eyeglasses lens capable of being framed in any kind of the V shaped groove 1*d* of all eyeglass.

Because the eyeglasses frame is measured in this state on the lens frame itself, which is different from the V shape groove that the V shaped portion is actually held in. Even when the lens with the V shaped portion is processed based on this measurement, the lens periphery that can be strongly held in the eyeglasses frame, is not realized.

Also, it is preferable that the tip end width (thickness) w of the contact element 2 is made equal to or larger than a width W of the lens frame 1 of eyeglasses frame in order for the eyeglasses lens to be framed in the eyeglasses frame in which the opening angle θ1 and the depth H of the V shaped groove, are different variously.

However, for the reason of the construction of lens frame shape measuring instrument, the lens frame 1 must be fixed so as to withstand the measurement pressure of the contact element 2, the tip end width (thickness) w of the contact element 2 could not be made equal to or larger than the width W of the lens frame 1 of eyeglasses frame because of prevention for the interference between a holding means for fixing the lens frame 1 and the tip end width (thickness) w of the contact element 2.

SUMMARY OF THE INVENTION

Object of the Invention

The present invention has been made to solve the above problems, and accordingly an object thereof is to provide a lens periphery processing method, a lens periphery processing machine and lens for eyeglass, in which a V shaped portion that fits strongly in a lens frame of eyeglasses frame, can be processed in such a manner that V shaped portion contact with inside of the V shaped groove of the lens frame so that a contact element does not interfere with a holding means for fixing and holding a lens frame, and even if the V shaped groove is measured in a state when the lens frame is tilted, a difference in size due to holding position between the lens frame and a processed eyeglasses lens, does not arise.

Summary of the Invention

To achieve the above object, the lens periphery processing method according to a first aspect of the present invention is characterized by comprising the steps of: measuring a lens frame shape of an eyeglasses frame by contacting a contact element at both sides of a V shaped groove formed in the inner face of a lens frame of an eyeglasses frame; and forming V shaped portion of said eyeglasses lens in a shape that the eyeglasses lens for said eyeglasses frame is put into said V shaped groove with contacting at the points where said contact element contacted on said both sides of the groove, as substantially the deepest contacting points in the groove.

The lens periphery processing machine according to a second aspect of the present invention is characterized by comprising: lens frame shape measuring means having a contact element contacting on both sides of a V shaped groove formed in the inner face of a lens frame of eyeglasses frame; and grinding means for processing a V shaped portion of lens for said eyeglasses frame based on lens frame shape data from said lens frame shape measuring means, wherein said grinding means forms V shaped portion of said eyeglasses lens in a shape that the eyeglasses lens for said eyeglasses frame is put into said V shaped groove with contacting at the points where said contact element contacted on said both sides of the groove, as substantially the deepest contacting points in the groove.

The lens periphery processing machine according to a third aspect of the present invention is characterized in that the grinding means has a grinding wheel having a processing tooth form of a shape for forming a tip end shape of the V shaped portion.

The eyeglasses lens according to a fourth aspect of the present invention is characterized in that the cross section of V shaped portion thereof is formed in a shape other than triangle, which is put into a V shaped groove formed at inner face of lens frame of said eyeglasses, with contacting on both sides of said V shaped groove.

DETAILED DESCRIPTION OF THE PREFERRED EMBODIMENTS

An embodiment of a lens grinding machine in which a lens grinding method in accordance with the present invention is used will now be described with reference to the accompanying drawings.

Embodiment 1

Figure 1:
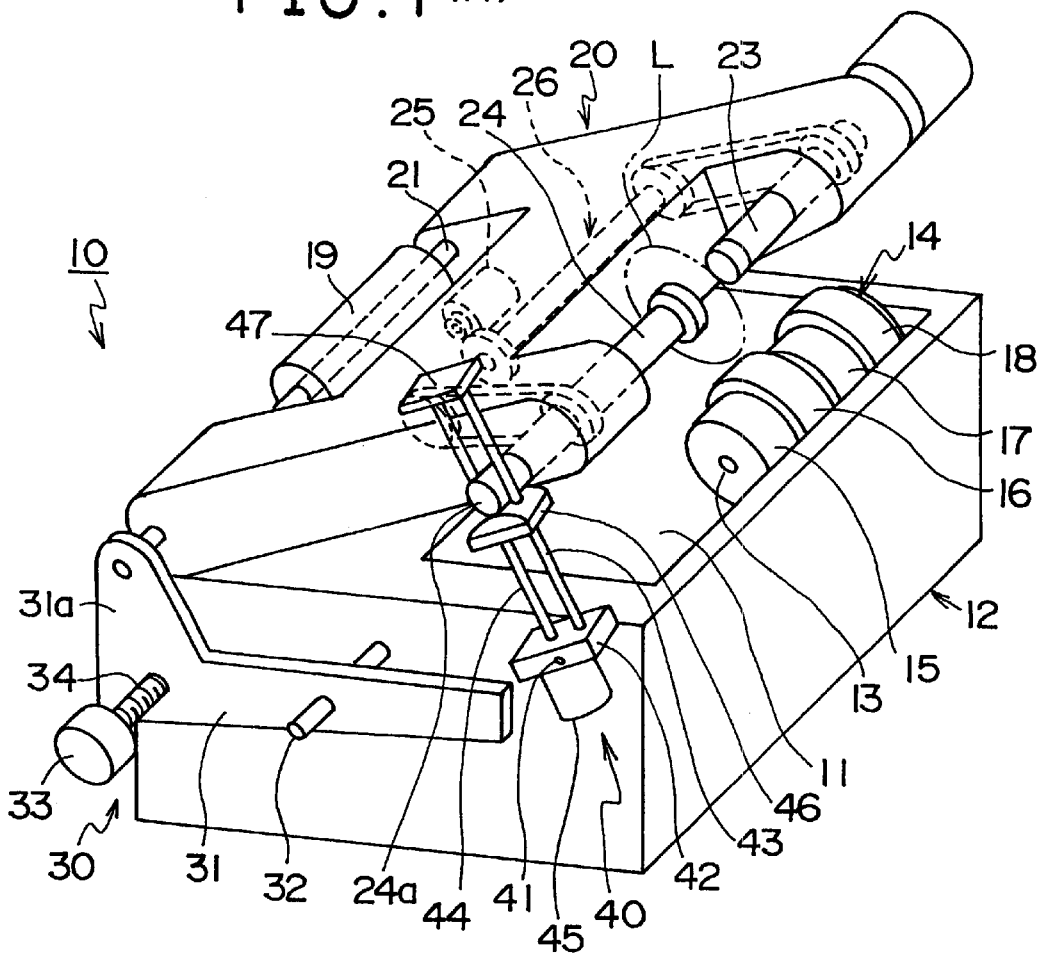
FIG. 1 shows a lens periphery processing machine, in which a lens periphery processing method for an eyeglasses lens is used, in accordance with a first embodiment of the present invention, FIG. 1A being a perspective view of an appearance of the lens periphery processing machine, and FIG. 1B being a front view of a grinding wheel.
Figure 1:
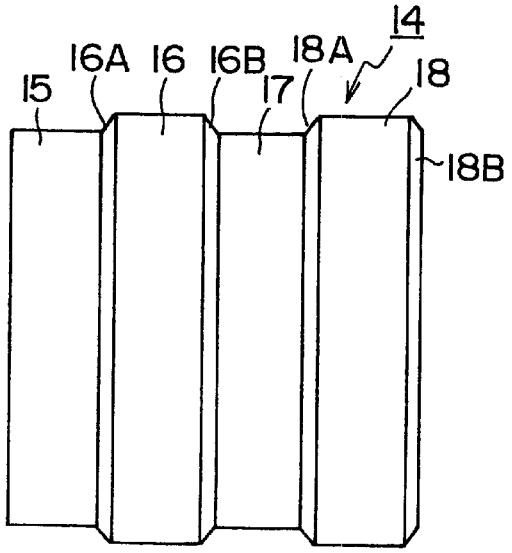

In FIG. 1A, a lens grinding machine (lens grinding machine or ball grinding machine) 10 has a housing 12 provided with a grinding wheel chamber 11. The grinding wheel chamber 11 contains a grinding wheel 14 that is rotated around a grinding wheel shaft 13 at a high speed by a motor, not shown.

The grinding wheel 14, having a cylindrical shape with a plurality of steps, as shown in FIG. 1B, is provided with a rough grinding wheel portion 15 for glass lens, a finish grinding wheel portion 16 for glass lens, a rough grinding wheel portion 17 for plastic lens, and a mirror finish grinding wheel portion 18 for plastic lens.

The finish grinding wheel portion 16 and the mirror finish grinding wheel portion 18 are formed into a cylindrical shape with a diameter larger than the diameters of the rough grinding wheel portion 15 and the rough grinding wheel portion 17. Also, at both ends of the finish grinding wheel portion 16 are formed inclined faces 16A and 16B inclined at a given angle θ a predetermined angle with respect to the radial direction). Similarly, at both ends of the mirror finish grinding wheel portion 18 are formed inclined faces 18A and 18B.

At the rear of the housing 12 is provided a bearing 19. In the bearing 19 is inserted a carriage revolving shaft 21 of a carriage 20 so as to be movable in the axial direction and rotatable.

The rear end portion of the carriage 20 is fixed to the carriage revolving shaft 21, so that the carriage 20 can be turned around the axis of the carriage revolving shaft 21 and also can be slid in the axial direction.

At one free end of the carriage 20, lens holding shafts 23 and 24 are held so as to be disposed on the same axis. On the lens holding shafts 23 and 24, a lens L to be processed is held therebetween. Also, the axes of lens holding shafts 23 and 24 are parallel with the axis of the grinding wheel shaft 13.

The lens holding shafts 23 and 24 are rotated by a drive motor 25 disposed in the carriage 20 via a publicly well known rotation transmitting mechanism 26. Also, the other end 24*a* of one lens holding shaft 24 projects from the side of the carriage 20.

At one side of the housing 12 is disposed carriage traversing means 30. The carriage traversing means 30 has an L-shaped arm member 31. The L-shaped arm member 31 is supported sidably on a shaft-like rail member 32 projecting from one side wall of the housing 12. Also, one end portion 31*a* of the L-shaped arm member 31 is attached to the carriage revolving shaft 21 so as to be capable of turning around the axis and incapable of moving transversely.

The carriage traversing means 30 has a traversing drive motor 33 fixed to a fixed frame, not shown, and a feed screw 34 installed to an output shaft (not shown) of the drive motor 33. The feed screw 34 is provided in parallel with the carriage revolving shaft 21, and is attached to the L-shaped arm member 31 by screw.

When the feed screw 34 is rotated in the normal or reverse direction by the rotation of the drive motor 33, the L-shaped arm member 31 moves transversely along the carriage revolving shaft 21, and at the same time, the carriage 20 moves through the same distance in the same direction.

Also, at one side of the housing 12 is provided axis-to-axis distance adjusting means 40. The axis-to-axis distance adjusting means 40 includes a base 42 installed to the housing 12 via a shaft 41 so as to be turned freely, a guide rail 43 installed to the base 42 so as to extend upward from the top face of the base 42 and to be at right angles to the top face of the base 42, a screw shaft 44 provided on the base 42 so as to be parallel with the guide rail 43 and to be capable of turning, a pulse motor 45 installed on the lower face of the base 42 to turn the screw shaft 44, a bearer 46 moved up and down along the guide rail 43 by the turning of the screw shaft 44, and a reinforcing member 47 fixed to the upper end of the guide rail 43 to hold the upper end of the screw shaft 44 so that the screw shaft 44 can be turned freely.

The shaft 41 is provided on the same axis as that of the grinding wheel 14, and the guide rail 43 and the screw shaft 44 extend upward from a point where the shaft 41 is held therebetween. Also, one end 24*a* of the lens holding shaft 24 is held between the guide rail 43 and the screw shaft 44, and can move along the guide rail 43.

The bearer 46 moves up and down along a straight line connecting the center of the shaft 41 (center of rotation of the grinding wheel 14) to the center of the one end 24*a* of the lens holding shaft 24 (center of rotation of the lens holding shaft 24). Also, the bearer 46 supports the one end 24*a* of the lens holding shaft 24. As the bearer 46 moves up and down (reciprocates) along the guide rail 43, the carriage 20 turns around the carriage revolving shaft 21.

Figure 2:
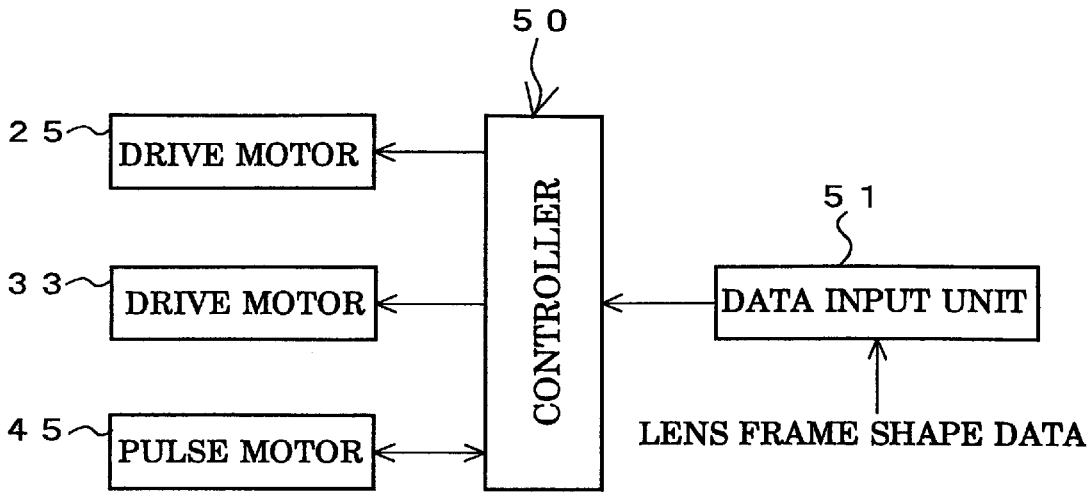
FIG. 2 is a block diagram of a control system for the lens periphery processing machine in accordance with a first embodiment of the present invention.

As shown in FIG. 2, the motors 25 and 33 and the pulse motor 45 are controlled by a controller 50. The controller 50 has a CPU and the like to control each of the motors 25, 33 and 45 based on frame shape data inputted from a data input unit 51. The controller 50 is provided in the housing 12.

Figure 3A:
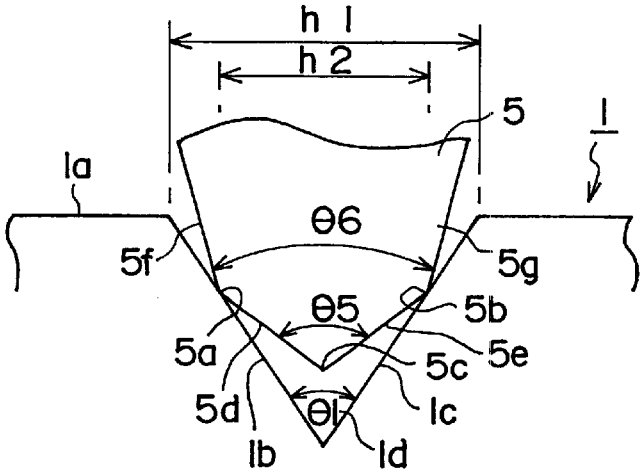
FIG. 3A is an explanatory view showing a state in which a lens frame is measured by using a contact element having a tip end of a ship bottom shape provided on a lens frame shape measuring instrument.
Figure 3B:
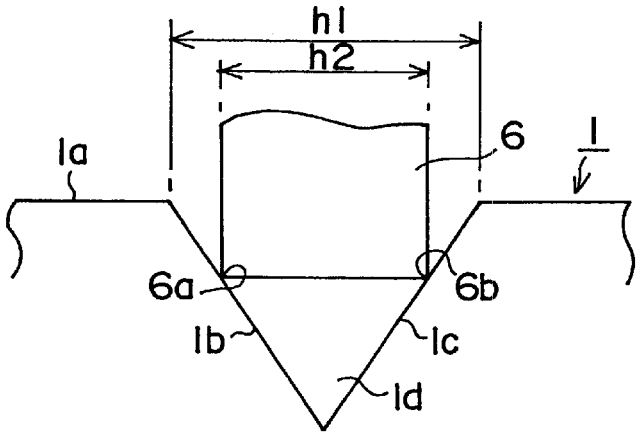
FIG. 3B is an explanatory view showing a state in which a lens frame is measured by using a contact element having a tip end of a rectangular shape provided on a lens frame shape measuring instrument.
Figure 3C:
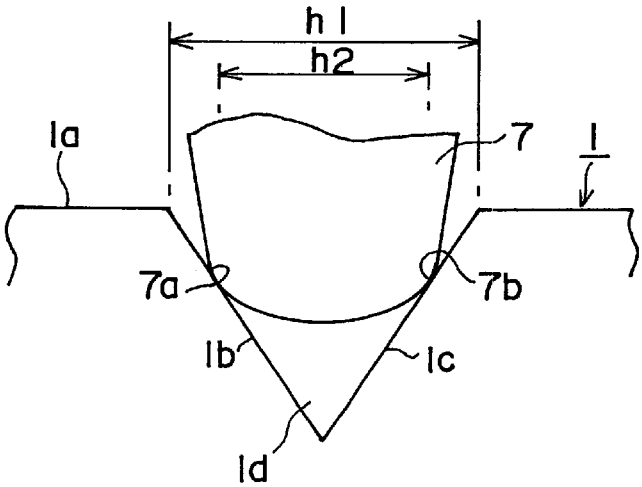
FIG. 3C is an explanatory view showing a state in which a lens frame is measured by using a contact element having a tip end of a semi-elliptic shape provided on a lens frame shape measuring instrument.

To the data input unit 51 is inputted the lens frame shape data. The lens frame shape data is obtained by measurement made, as shown in FIGS. 3A to 3C, by contacting a contact element 5 (contact element 6 and contact element 7) into contact with a V shaped groove 1*d* having inclined faces 1*b* and 1*c* having a V shape formed in an inner face 1*a* of a lens frame 1 of an eyeglasses frame.

The contact element 5, 6, 7 has a pair of inclined face contact portions 5*a* and 5*b*(inclined face contact portions 6*a* and 6*b* and inclined face contact portions 7*a* and 7*b*) with a width h2 which is narrower than an opening width h1 in perpendicular to the extending direction of the V shaped groove 1*d*. The paired inclined face contact portions 5*a*, 5*b*, 6*a*, 6*b*, 7*a* and 7*b* are brought into contact with intermediate portions on the inclined faces 1*b* and 1*c* to make measurement.

The contact points at which the paired inclined face contact portions 5*a*, 5*b*, 6*a*, 6*b*, 7*a* and 7*b* are in contact with the inclined faces 1*b* and 1*c*are set so that the portions opposed to each other are kept at almost the same depth h3 from the inner face 1*a* of the V shaped groove 1*d*. Thereby, a radial distance from the geometrical center (not shown) of the lens frame 1 to the contact point where the inclined face contact portions 5*a*, 5*b*, 6*a*, 6*b*, 7*a* and 7*b* are in contact with the inclined faces 1*b* and 1*c* is measured as the lens frame shape of eyeglasses frame.

As shown in FIG. 3, the tip end shape of the contact element 5, 6, 7 may be such that the above described relationship between the opening width h1 of the V shaped groove 1*d*and the width h2 is maintained, where h2 is the width between the paired inclined face contact portions 5*a*, 5*b*, 6*a*, 6*b*, 7*a* and 7*b*, and there are provided the inclined face contact portions 5*a*, 5*b*, 6*a*, 6*b*, 7*a* and 7*b* that can come into contact with the intermediate portions on the inclined faces 1*b* and 1*c*.

The contact element 5 shown in FIG. 3A is formed of a composite face composed of gradually inclined faces 5*d* and 5*e* that open at an opening angle θ5 from a tip end vertex 5*c* and sharply inclined faces 5*f* and 5*g* that open at an opening angle of (6 and are continuous from the proximal ends of the gradually inclined faces 5*d* and 5*e*.

In this case, the opening angle θ5 between the gradually inclined faces 5*d* and 5*e* is set so as to be larger than the opening angle θ6 between the sharply inclined faces 5*f* and 5*g*. Also, the opening angle θ5 between the gradually inclined faces 5*d* and 5*e* is set so as to be larger than an opening angle θ1 between the paired inclined faces 1*b* and 1*c* of the V shaped groove 1*d*.

Also, the contact element 6 shown in FIG. 3B has a rectangular tip end shape, and the contact element 7 shown in FIG. 3C has a semi-elliptic tip end shape (a spherical shape is also allowed).

Next, the operation of the lens grinding machine performed on the basis of the lens frame shape data inputted in the data input unit 51 will be described.

Figure 4:
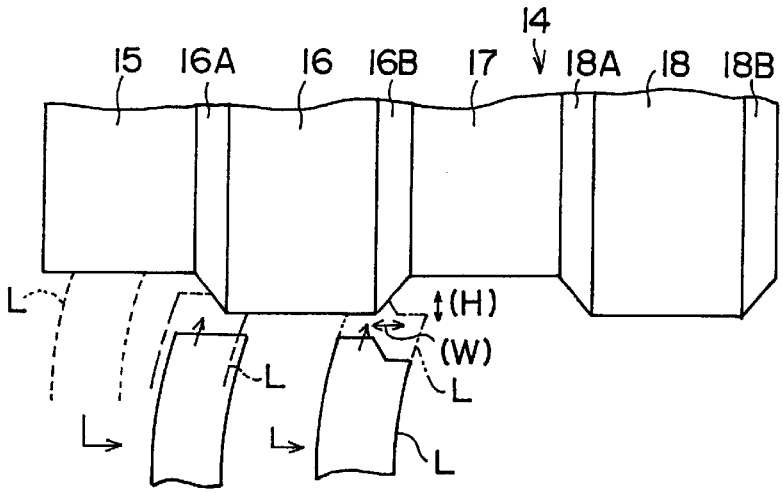
FIG. 4A is an explanatory view showing a lens processing process from step i to step iii using a grinding wheel.
FIG. 4B is an explanatory view showing a lens processing process of step iv using the grinding wheel.
FIG. 4C is an explanatory view showing a lens processing process of step v using the grinding wheel.
Figure 4:
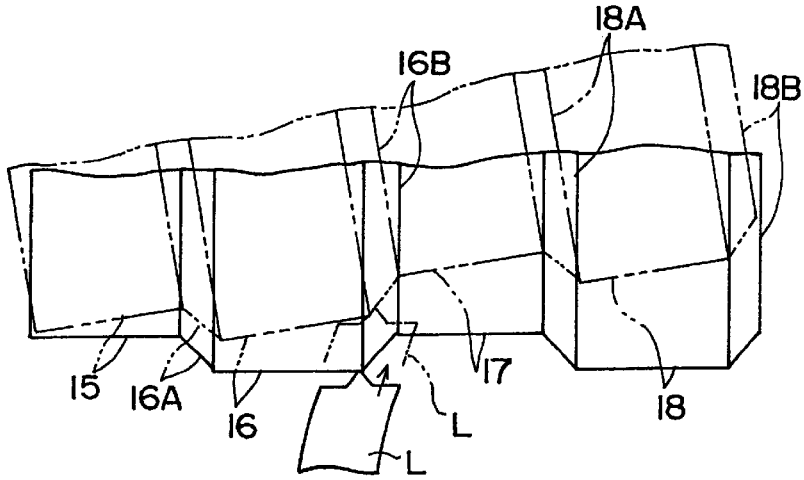
Figure 4:
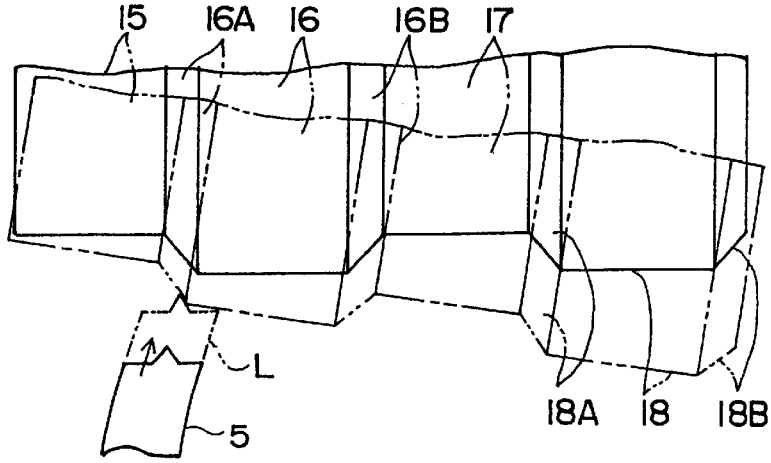

First, by driving the drive motor 33 and the pulse motor 45, the carriage 20 is moved to the right and is turned up or down to perform rough grinding by contacting the edge face of a lens L being processed into contact with the rough grinding wheel portion 15 of the grinding wheel 14 as indicated by the broken line in FIG. 4A (step i).

Next, by driving the drive motor 33 and the pulse motor 45, the carriage is moved to left and is turned up or down to carry on the grinding operation by contacting the finish grinding wheel portion 16 and the inclined face 16A into contact with the right side (rear side) of the edge face of the lens L being processed as indicated by the dotted broken line in FIG. 4A (step ii).

Subsequently, by driving the drive motor 33 and the pulse motor 45, the carriage 20 is moved to the left and is turned up or down to carry on the grinding operation by contacting the finish grinding wheel portion 16 and the inclined face 16B into contact with the left side (front side) of the edge face of the lens L being processed as indicated by the double dotted broken line in FIG. 4A (step iii).

Further, as shown in FIG. 4B, by driving the not illustrated motor, the grinding wheel shaft 13 (see FIG. 1A) of the grinding wheel 14 is turned so that the side of the mirror finish grinding wheel portion 18 of the grinding wheel 14 is inclined upward. Thereby, the inclined face 16B of the grinding wheel portion 16 is brought into contact with a portion near the vertex of the V shaped portion formed on the left side (front side) of the edge face of the lens L being processed as indicated by the double dotted broken line in FIG. 4B (step iv).

Subsequently, as shown in FIG. 4C, by driving a motor which is not shown, the grinding wheel shaft 13 (see FIG. 1A) of the grinding wheel 14 is turned so that the side of the mirror finish grinding wheel portion 18 of the grinding wheel 14 is inclined downward. Thereby, the inclined face 16A of the grinding wheel portion 16 is brought into contact with a portion near the vertex of the V shaped portion formed on the right side (rear side) of the edge face of the lens L being processed as indicated by the double dotted broken line in FIG. 4C (step v).

Figure 5:
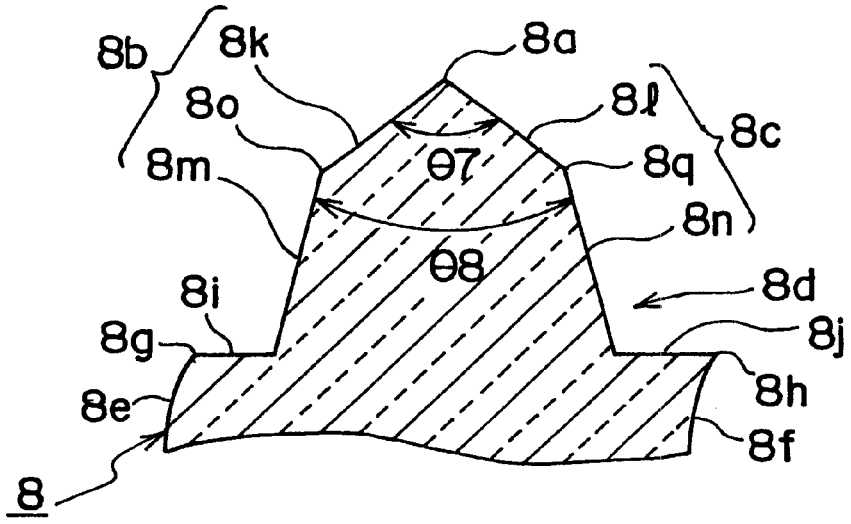
FIG. 5A is a sectional view showing one example of a V shaped portion.
FIG. 5B is a sectional view showing another example of a V shaped portion.
Figure 5:
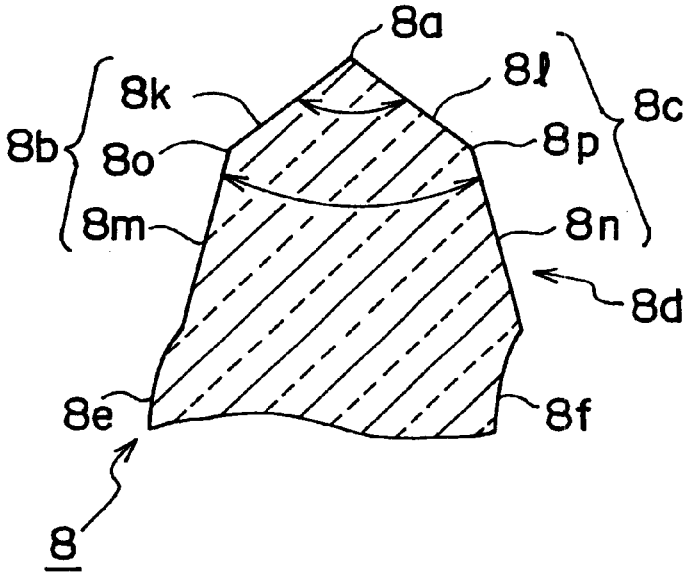

FIGS. 5A and 5B show shapes of a V shaped portion of an eyeglasses lens 8 obtained by processing the lens L being processed through steps i to v. As shown in FIGS. 5A and 5B, the shape differs according to the portion of the eyeglasses lens 8.

The eyeglasses lens 8 in the portion shown in FIG. 5A is formed with a V shaped portion 8*d* having a pair of composite inclined faces 8*b* and 8*c* that are symmetrical transversely so that a vertex 8*a* (ridge line) of the V shaped portion is tapered. On the sides of a lens front face 8*e* and lens rear face 8*f* of the V shaped portion 8*d*, a V shaped portion shoulder 8*i* ranging from the front foot of the V shaped portion 8*d* to a lens front edge 8*g* and a V shaped portion shoulder 8*j* ranging from the rear foot to a lens rear edge 8*h*, which have a width different according to the peripheral point of the eyeglasses lens 8, are formed at the same time that the V shaped portion 8*d* is formed.

The eyeglasses lens 8 in the portion shown in FIG. 5B is in a state in which the V shaped portion shoulders 8*i* and 8*j* are not formed.

The composite inclined faces 8*b* and & are formed of gradually inclined faces 8*k* and 8*l* that open at an opening angle θ7 (almost the same angle as the opening angle θ5) from the vertex 8*a* (ridge line) of the V shaped portion and sharply inclined faces 8*m* and 8*n* that open at an opening angle of (8 (almost the same angle as the opening angle θ6) and are continuous from the proximal ends of the gradually inclined faces 8*k* and 8*l*. At the same time, the boundary portion of the composite inclined faces 8*b* and 8*c* forms the vertex, forming contact portions 8*o* and 8*p*.

In this case, the opening angle θ7 between the gradually inclined faces 8*k* and 8*l* is set so as to be larger than the opening angle θ8 between the sharply inclined faces 8*m* and 8*n* . Also, the opening angle θ7 between the gradually inclined faces 8*k* and 8*l* is set so as to be larger than the opening angle θ1 between the paired inclined faces 1*b* and 1*c* of the V shaped groove 1*d*. Also, the angle θ8 is set so as to be smaller than the angle θ1.

In the case where the lens L being processed is a plastic lens, the operation differs from that for a glass lens in that the used portions of the grinding wheel 14 are the rough grinding wheel portion 17, mirror finish grinding wheel portion 18, and inclined faces 18A and 18*b*, and the process etc. for processing the lens L are substantially the same.

Figure 6:
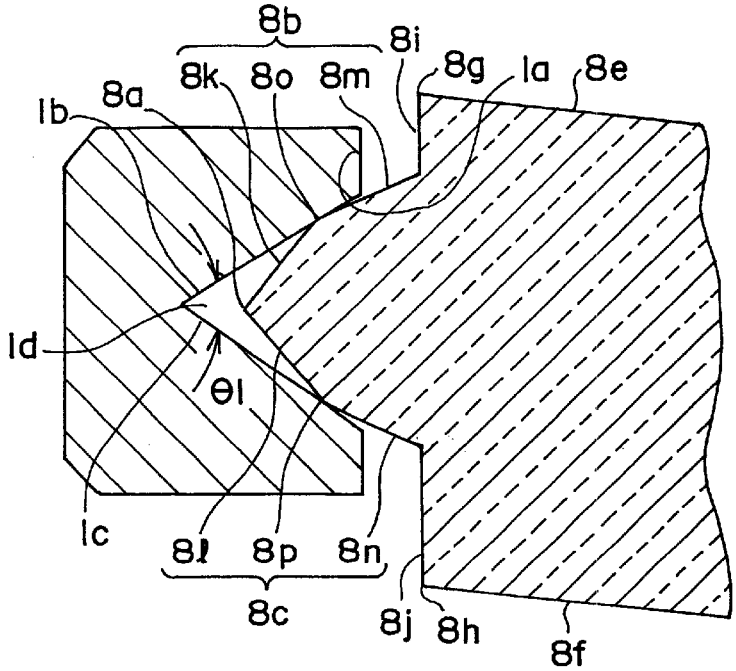
FIG. 6A is a sectional view of an essential portion of an eyeglasses lens framed in a lens frame.
FIG. 6B is a sectional view of another essential portion of an eyeglasses lens framed in a lens frame.
Figure 6:
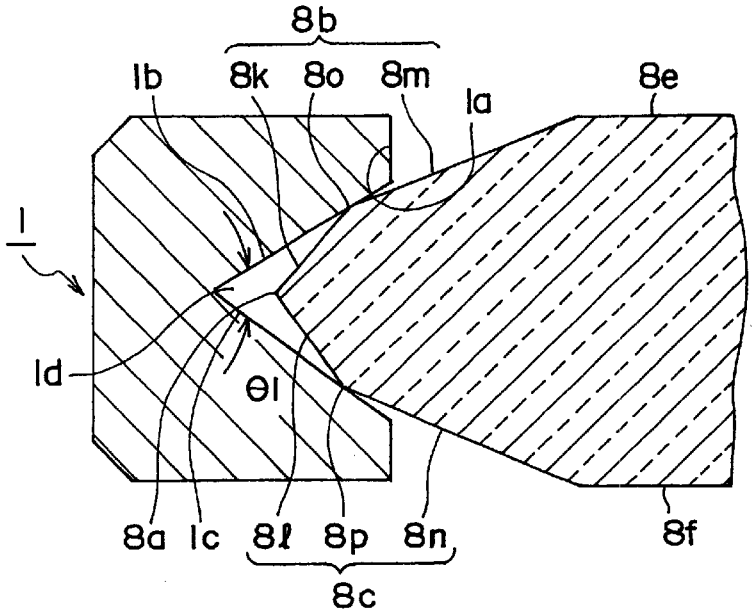

Therefore, when the eyeglasses lens 8 is inserted in the V shaped groove 1*d*and is framed in the lens frame 1, for example, the eyeglasses lens 8 of the portion shown in FIG. 5A is in the state shown in FIG. 6A, and the eyeglasses lens 8 of the portion shown in FIG. 5B is in the state shown in FIG. 6B.

In both of the cases, the contact portions 8*o* and 8*p*, which are vertexes of the composite inclined faces 1*b* and 1*c*, are in contact with the intermediate portions on the paired inclined faces 1*b* and 1*c* of the lens frame 1, which are opposed to each other and have the same depth.

Thereby, the contact portions 8*o* and 8*p* at which the eyeglasses lens 8 is in contact with the lens frame 1 are positioned inside the V shaped groove edge of the lens frame 1. Therefore, even if the opening angle θ1 of the V shaped groove 1*d*of the lens frame 1 of eyeglasses frame and a depth H of the V shaped groove 1*d* are different, the tip end contact state of the contact element 6 of a lens frame shape measuring instrument and the contact state of the finish processed eyeglasses lens 8 can be allowed to coincide with each other.

Thereupon, even if the shape of the V shaped groove 1*d*is measured in a state in which the lens frame 1 is tilted slightly, a difference in size between the V shaped groove 1*d*of the lens frame 1 and the finish processed eyeglasses lens 8 is less liable to arise, so that the eyeglasses lens 8 can be framed in the lens frame 1 securely.

Embodiment 2

Figure 7A:
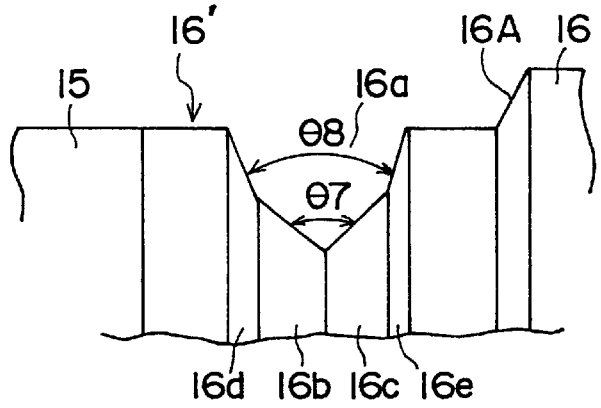
FIG. 7 shows a lens periphery processing machine, in which a lens periphery processing method for an eyeglasses lens is used, in accordance with a second embodiment of the present invention, FIG. 7A being an enlarged front view of an essential portion of a grinding wheel, FIG. 7B being an explanatory view of a lens fabrication process for a portion using the grinding wheel, and FIG. 7C being an explanatory view of a lens fabrication process for another portion using the grinding wheel.
Figure 7B:
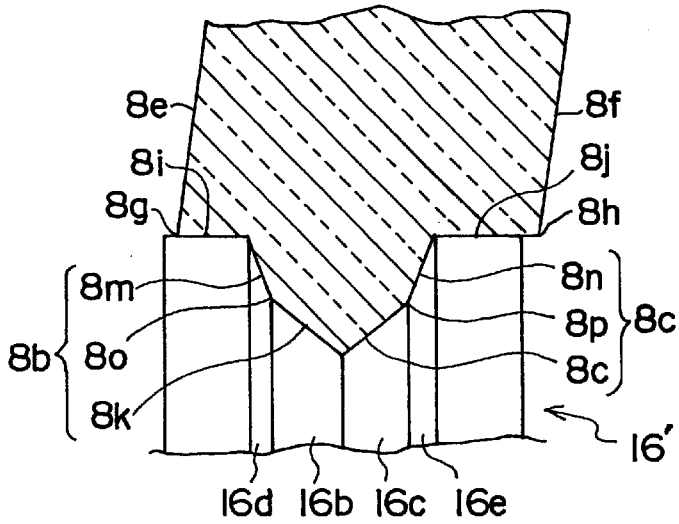
Figure 7B:
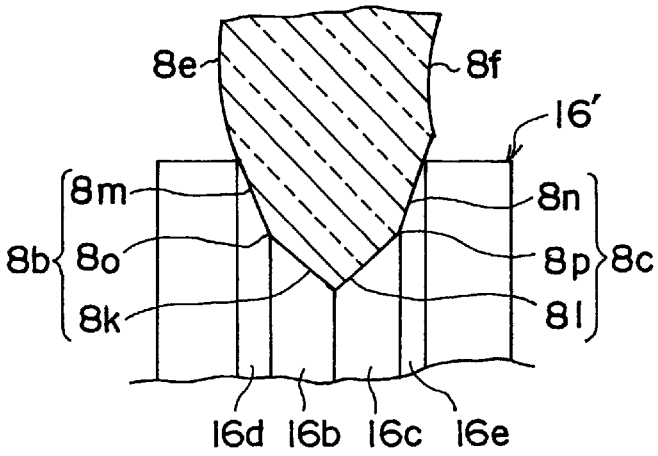
Figure 8:
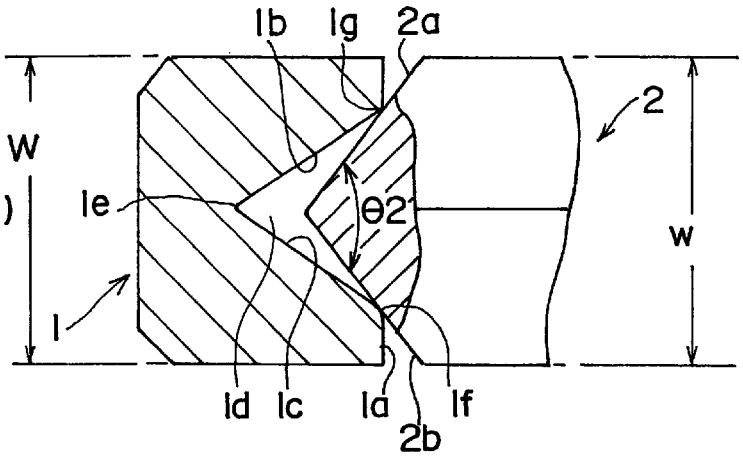
FIG. 8 shows a conventional lens periphery processing method for an eyeglasses lens, FIG. 8A being an explanatory view of an essential portion in a state in which a lens frame shape is measured using a contact element, FIG. 8B being an explanatory view of a lens fabrication state, and FIG. 8C being an explanatory view of an eyeglasses lens being framed.
Figure 8:
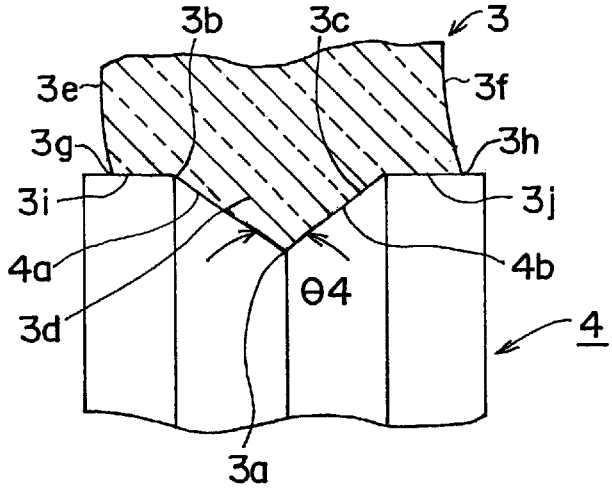
Figure 8:
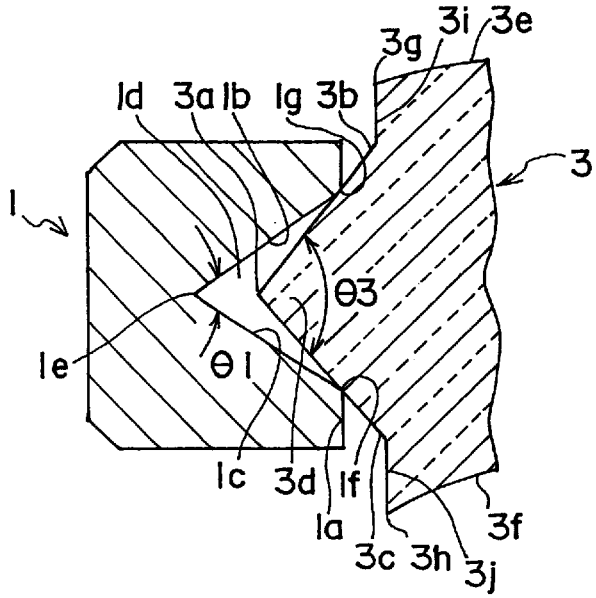
Figure 9A:
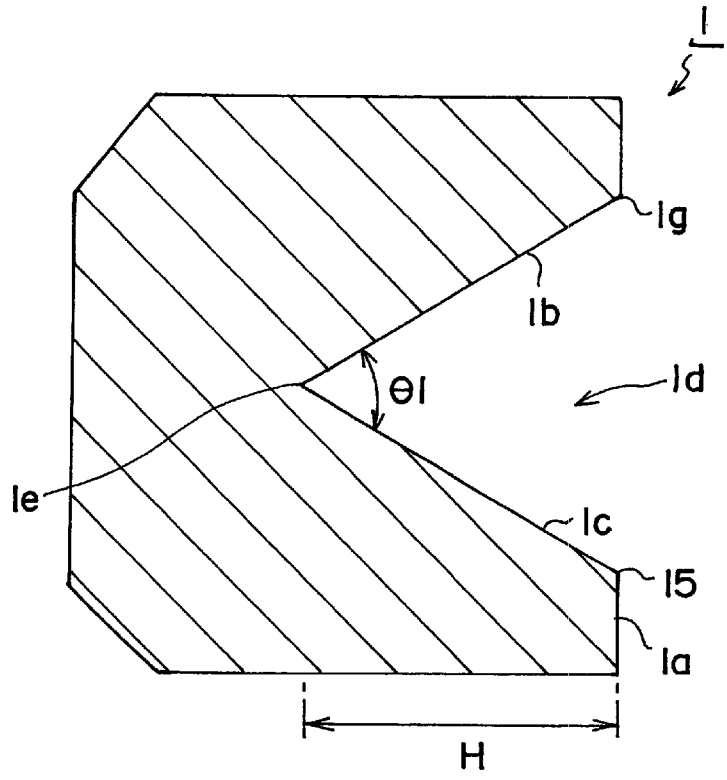
FIG. 9A is a sectional view of a lens frame which is viewed in the direction perpendicular to the lens frame extending direction.
Figure 9B:
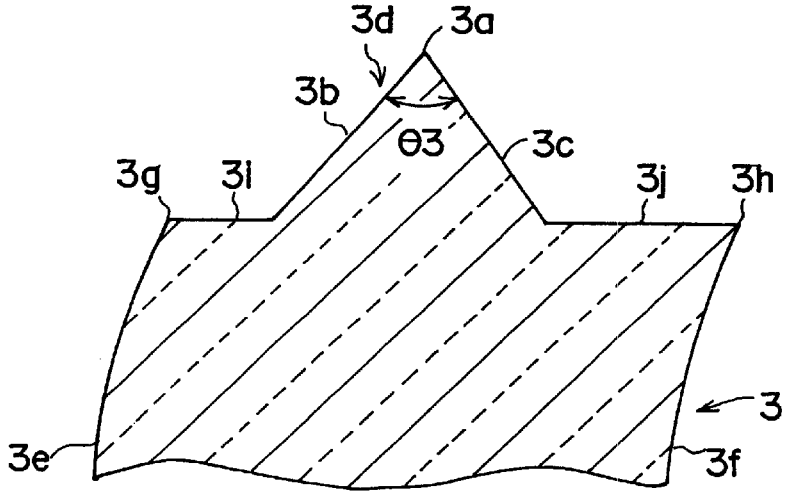
FIG. 9B is a sectional view of a V shaped portion of an eyeglasses lens.

FIG. 7 shows a second embodiment of a lens periphery processing machine for an eyeglasses lens in accordance with the present invention. In the above described first embodiment, the grinding wheel 14 is inclined upward and downward to fabricate the V shaped portion in steps iv and v. On the other hand, in the second embodiment, the V shaped portion is processed without inclining the grinding wheel 14.

Specifically, as shown in FIG. 7A, for a grinding wheel 14', for example, a V shaped portion finish grinding wheel portion 16' serving as a processing tooth form is provided between, for example, the rough grinding wheel portion 15 and the finish grinding wheel portion 16, in addition to the rough grinding wheel portion 15 for glass lens, the finish grinding wheel portion 16 for glass lens, the rough grinding wheel portion 17 for plastic lens, and the mirror finish grinding wheel portion 18 for plastic lens described above (some of them not shown), and there is provided a composite inclined concave 16*a* in which the cross-sectional shape of the V shaped portion finish grinding wheel portion 16' coincides substantially with the cross-sectional shape of the V shaped portion 8*d*.

As shown in FIGS. 7B and 7C, the composite inclined concave 16*a* has gradually inclined grinding faces 16*b* and 16*c* and sharply inclined grinding faces 16*d* and 16*e* to form the gradually inclined faces 8*k* and 8*l*, the sharply inclined faces 8*m* and 8*n* , and the contact portions 8*n* and 8*p* on the composite inclined faces 8*b* and 8*c* of the V shaped portion 8*d* at the same time. A V shaped portion finish grinding wheel portion for plastic lens may be provided according to the lens material and the kind of fabrication.

Thereupon, after the fabrication in the above described steps i to iii has been performed, the V shaped portion 8*d* is formed by using the V shaped portion finish grinding wheel portion 16' of the grinding wheel 14'.

In the above described embodiments, the V shaped portion which has a pentagonal cross section are employed, however, the effect of present invention can be attained in any eyeglasses lens with V shaped portion which contacts with the V shaped groove at the inside <>?<>

According to the present invention, even for a lens frame of eyeglasses frame in which the opening angle and depth of the V shaped groove differ variously, or even if the V shaped groove shape is measured in the state in which the lens frame is tilted slightly, the contact element does not interfere with the holding means for fixing and holding the lens frame, and a difference in size between the V shaped groove of the lens frame and the finish processed eyeglasses lens does not arise. Therefore, the present invention achieves an effect that the shape of the lens frame can be measured so as to correspond to the contact point at which the V shaped portion of the finish processed eyeglasses lens is in contact with the lens frame in the state in which the frame is fixed securely, and the V shaped portion can be processed so as to correspond to the contact point by using this shape data.

What is claimed is:

1. A lens periphery processing method for an eyeglasses lens, comprising the steps of:

providing an eyeglasses frame with a lens frame having a V-shaped groove formed in its inner face;

measuring shape data of said eyeglasses lens frame by contacting contact points on both sides of the V-shaped groove; and processing an eyeglasses lens using said shape data of said eyeglass lens frame to form a V-shaped portion at the edge of the lens, which V-shaped portion when installed into said V-shaped groove provides contact with said contact points on both sides of the groove, wherein said contact points are substantially the deepest contact points of the groove.

2. The lens periphery processing method for an eyeglasses lens according to claim 1, wherein the shape data of the eyeglasses frame is a radial distance from a geometrical center of the lens frame to the contact points.

3. An eyeglasses lens periphery processing apparatus comprising:

lens frame shape measuring means having a contact element for contacting contact points on both sides of a V-shaped groove formed in an inner face of an eyeglasses lens frame; and grinding means for processing a lens for said eyeglasses frame forming a V-shaped portion on a periphery of said lens based on lens frame shape data from said lens frame shape measuring means;

wherein said V-shaped portion of said eyeglasses lens when installed into said V-shaped groove of said eyeglasses lens frame provides contact at said contact points on said both sides of the groove, said contact points being substantially the deepest contact points of the groove.

4. The eyeglasses lens periphery processing apparatus according to claim 3, further comprising a grinding wheel having a plurality of steps and rotatably positioned on a grinding wheel shaft for grinding the edge of an eyeglass lens, and lens rotating shafts for interposing and holding the eyeglass lens therebetween, the lens rotating shafts being supported by a carriage rotatably mounted on a revolving shaft and movable in axial direction, axes of lens rotating shafts being parallel to the grinding wheel shaft.

5. The eyeglasses lens periphery processing apparatus according to claim 4, further comprising axis-to-axis distance adjusting means.

6. The eyeglasses lens periphery processing apparatus according to claim 5, further comprising a controller to control the lens processing based on the lens frame shape data.

7. The lens periphery processing apparatus according to claim 3, wherein said grinding wheel comprises at least one rough grinding wheel step, and at least one finish grinding wheel step having inclined faces.

8. The lens periphery processing apparatus according to claim 7, further comprising a processing tooth having a shape corresponding to a shape of a tip end of said V-shaped portion, the processing tooth being positioned between the rough grinding wheel step and the finish grinding wheel step.

9. An eyeglasses lens periphery processing apparatus, comprising:

lens frame shape measuring means having a contact element for contacting contact points on both sides of a V-shaped groove formed in an inner face of an eyeglasses lens frame; and grinding means for processing a lens for said eyeglasses frame forming a V-shaped portion on a periphery of said lens based on lens frame shape data from said lens frame shape measuring means;

wherein said V-shaped portion of said eyeglasses lens when installed into said V-shaped groove of said eyeglasses lens frame provides contact at said contact points on said both sides of the groove, said contact points being substantially the deepest contact points of the groove, and wherein the contact element comprises a pair of gradually inclined faces forming a first opening angle from a tip end vertex, a pair of inclined face contact portions, and a pair of sharply inclined faces forming a second opening angle.

10. The lens periphery processing apparatus according to claim 9, wherein said first opening angle is larger than said second opening angle.

11. An eyeglasses lens periphery processing apparatus, comprising:

lens frame shape measuring means having a contact element for contacting contact points on both sides of a V-shaped groove formed in an inner face of an eyeglasses lens frame; and grinding means for processing a lens for said eyeglasses frame forming a V-shaped portion on a periphery of said lens based on lens frame shape data from said lens frame shape measuring means;

wherein said V-shaped portion of said eyeglasses lens when installed into said V-shaped groove of said eyeglasses lens frame provides contact at said contact points on said both sides of the groove, said contact points being substantially the deepest contact points of the groove, and wherein the contact element has a rectangular tip end.

12. An eyeglasses lens periphery processing apparatus, comprising:

lens frame shape measuring means having a contact element for contacting contact points on both sides of a V-shaped groove formed in an inner face of an eyeglasses lens frame; and grinding means for processing a lens for said eyeglasses frame forming a V-shaped portion on a periphery of said lens based on lens frame shape data from said lens frame shape measuring means;

wherein said V-shaped portion of said eyeglasses lens when installed into said V-shaped groove of said eyeglasses lens frame provides contact at said contact points on said both sides of the groove, said contact points being substantially the deepest contact points of the groove, and wherein the contact element has a rounded tip end.

13. A lens for eyeglasses comprising a V-shaped portion on its periphery in order to provide a secure framing by inserting the V-shaped portion of the lens into a V-shaped groove formed in an inner face of a lens frame, so as to provide a contact with contact points on both sides of the V-shaped groove of the lens frame.

14. A lens for eyeglasses comprising a V-shaped portion on its periphery in order to provide a secure framing by inserting the V-shaped portion of the lens into a V-shaped groove formed in an inner face of a lens frame, so as to provide a contact with contact points on both sides of the V-shaped groove of the lens frame, wherein the V-shaped portion has a pair of composite inclined faces and a tapered vertex.

15. A lens for eyeglasses, comprising a V-shaped portion on its periphery in order to provide a secure framing by inserting the V-shaped portion of the lens into a V-shaped groove formed in an inner face of a lens frame, so as to provide a contact with contact points on both sides of the V-shaped groove of the lens frame, wherein the V-shaped portion comprises a pair of gradually inclined faces that open at a first opening angle from a vertex of the V-shaped portion, a pair of contact portions, and a pair of sharply inclined faces opened at a second opening angle.

16. The lens for eyeglasses according to claim 15, wherein the first opening angle is larger than the second opening angle.

17. The lens for eyeglasses according to claim 16, wherein the first opening angle is larger than an opening angle between inclined faces of the V-shaped groove of the lens frame, and the second opening angle is smaller than the opening angle of the V-shaped groove.

18. The lens for eyeglasses according to claim 14, further comprising a pair of V-shaped portion shoulders between a front foot of the V-shaped portion and a lens front edge and between a rear foot of the V-shaped portion and a lens rear edge, respectively.

19. The lens for eyeglasses according to claim 15, wherein a cross section of the V-shaped portion of the lens is formed in a shape different from a triangle.

20. The lens for eyeglasses according to claim 19, wherein the V-shaped portion of the lens has a pentagonal cross section.

* * * * *